US005428973A

United States Patent [19]

Temmyo et al.

[11] Patent Number: 5,428,973

[45] Date of Patent: Jul. 4, 1995

[54] REFRIGERATOR WITH MEANDERING AIR DUCT FOR WIRE AND TUBE CONDENSER

[75] Inventors: Minoru Temmyo, Tokyo; Masato Tago; Koji Kashima, both of Kanagawa, all of Japan

[73] Assignee: Kabushiki Kaisha Toshiba, Kawasaki, Japan

[21] Appl. No.: 975,909

[22] Filed: Nov. 13, 1992

[51] Int. Cl.[6] ..... F25D 19/00

[52] U.S. Cl. ..... 62/452; 62/456; 62/454; 62/455; 165/157; 454/906

[58] Field of Search ..... 62/452, 454, 455, 456, 62/507, 508; 165/157, 159, 122; 454/906

[56] References Cited

U.S. PATENT DOCUMENTS

| | | | |
|---|---|---|---|
| 2,797,553 | 7/1957 | Baillif | 62/454 X |
| 3,127,324 | 3/1964 | Parr et al. | 165/157 X |
| 3,162,023 | 12/1964 | Smith | 62/455 |
| 3,230,734 | 1/1966 | Koch | 62/455 X |
| 3,524,329 | 8/1970 | Smith et al. | 62/508 X |
| 3,759,059 | 9/1973 | Kenyon | 62/56 x |
| 3,785,168 | 1/1974 | Domingorene | 62/454 X |
| 4,490,991 | 1/1985 | Griffin | 62/455 X |
| 5,083,443 | 1/1992 | Von Blanquet | 62/508 X |

FOREIGN PATENT DOCUMENTS

| | | | |
|---|---|---|---|
| 48729 | 6/1938 | France | 62/456 |
| 1254495 | 1/1961 | France | 62/452 |
| 721839 | 6/1942 | Germany | 62/455 |
| 7112630 | 7/1982 | Japan | 454/906 |
| 4009571 | 1/1992 | Japan | 62/455 |
| 85333 | 4/1955 | Norway | 454/906 |

*Primary Examiner*—Christopher Kilner
*Attorney, Agent, or Firm*—Foley & Lardner

[57] ABSTRACT

A refrigerator having an air passage duct which contains therein a wire and tube condenser where a cooling air caused by a fan flows. A refrigerator includes: a machine compartment having a fan therein for causing a flow of cooling air, located at a bottom of the refrigerator; an air passasge duct, connected to the machine compartment, containing a wire and tube condenser (referred to as a wire condenser hereinafter), the air duct and the wire condenser being placed at the bottom of the refrigerator; and an exhaust port for discharging an air used for radiating a heat of the wire condenser, wherein the air passage duct is formed in a zigzag shape so that the cooling air flowing through the air passage duct crosses through the wire condenser.

9 Claims, 6 Drawing Sheets

REFRIGERATOR WITH MEANDERING AIR DUCT FOR WIRE AND TUBE CONDENSER

BACKGROUND OF THE INVENTION

1. Field of the Invention

The present invention relates to a refrigerator, and it particularly relates to a refrigerator in which a condenser thereof is in an efficient arrangement.

2. Description of the Prior Art

A recent trend has been increasing sizes of refrigerators. As a result, it is becoming more common to locate the condenser of such a refrigerator in an air duct so that the condenser is cooled by an air flow caused by a fan. A typical structure is shown in FIG. 1. Fan 101 is located in machine compartment 103. An air duct passage 105 is connected to the machine compartment 103. Wire and tube condenser 107 (simply referred to as a wire condenser hereinafter) which contains therein a refrigerant is disposed within the air duct passage 105. Cool air is guided from an intake 109 of the air duct passage 105 so as to remove heat radiated from the wire condenser 107. The heated air is then discharged to the outside through the machine compartment 103.

The cooled air flows in a direction indicated as in FIG. 1. Due to a limited space for the air duct passage 105, the wire condenser 107 and the air duct passage 105 must be configured in a straight horizontal direction.

This horizontal configuration causes the cooled air to simply flow along an upper surface and lower surface of the wire condenser 107 in the horizontal direction, instead of crossing through the wire condenser 107 which would result in a more optimum cooling efficiency. In particular, the horizontal configuration causes the cooled air to heat up in the downstream side of the air duct passage, which prevents efficient cooling of the wire condenser 107.

Referring still to FIG. 1, in order to alleviate the problem described above, a part or whole of the wire condenser 107 can be tilted (shown as a dotted line) so that the cooled air flows and crosses through the part of the wire condenser 107. However, a dead space S will be formed as a result of tilting the wire condenser 107, which increases the cross section area of the air conduct passage 105. As a result, the tilted wire condenser 105 reduces the storage space of the refrigerator.

Though the wire condenser is illustrated such that it is placed at the bottom of the refrigerator, this is only for convenience to better explain the present invention in "DETAILED DESCRIPTION OF THE PREFERRED EMBODIMENTS" to follow.

A heat exchanger of a refrigerator utilizing the wire condenser includes a condenser portion and an evaporator. The condenser portion is a tube condenser, which has a refrigerant flowing therein, and a wire for interposing and reinforcing the tube condenser.

Conventionally, a hot wall condenser is attached to a rear side or right and left sides of the refrigerator as shown in FIG. 2A and FIG. 2B. This placement causes a problem in terms of space necessary for the wire condenser. Moreover, considering global environmental concerns, such conventional refrigerators cannot be easily and conveniently disassembled to aid in, for example, recycling. Moreover, when the wire condenser is mounted on the rear side of the refrigerator, such refrigerator cannot be built into a wall or the like in a kitchen.

SUMMARY OF THE INVENTION

In view of the foregoing problems, it is therefore an object of the present invention to provide a refrigerator with a wire and tube condenser therein where the wire and tube condenser is cooled most efficiently without increasing the cross section of an air passage duct which contains the wire and tube condenser.

To achieve the object, there is provided a refrigerator comprising: a machine compartment having a fan therein for causing a flow of cooling air, located at a bottom of the refrigerator; an air passage duct, connected to the machine compartment, containing a wire and tube condenser (referred to as a wire condenser hereinafter), the air duct and the wire condenser being placed at the bottom of the refrigerator; and an exhaust port for discharging air used for removing heat radiated from the wire condenser, wherein the air duct is formed in a zigzag shape so that cooling air crosses through the wire condenser.

Other features and advantages of the present invention will become apparent from the following description taken in conjunction with the accompanying drawings.

DETAILED DESCRIPTION OF THE PREFERRED EMBODIMENTS

The present invention offers an environmentally conscious refrigerator with a wire condenser which is placed at the bottom of the refrigerator and is a compact unit. This refrigerator is easy to disassemble and can be recycled more efficiently. By providing the wire condenser in the bottom of the refrigerator, the space required therefor is reduced and the refrigerator can be easily and conveniently disassembled which also contributes to a better global environment.

Features of the present invention will become apparent in the course of the following description of exemplary embodiments which are given for illustration of the invention and are not intended to be limiting thereof. Embodiments of the present invention will now be described with reference to the drawings.

With reference to FIG. 3 through FIG. 9, the first to fourth embodiments will be described in detail.

Figure 6:
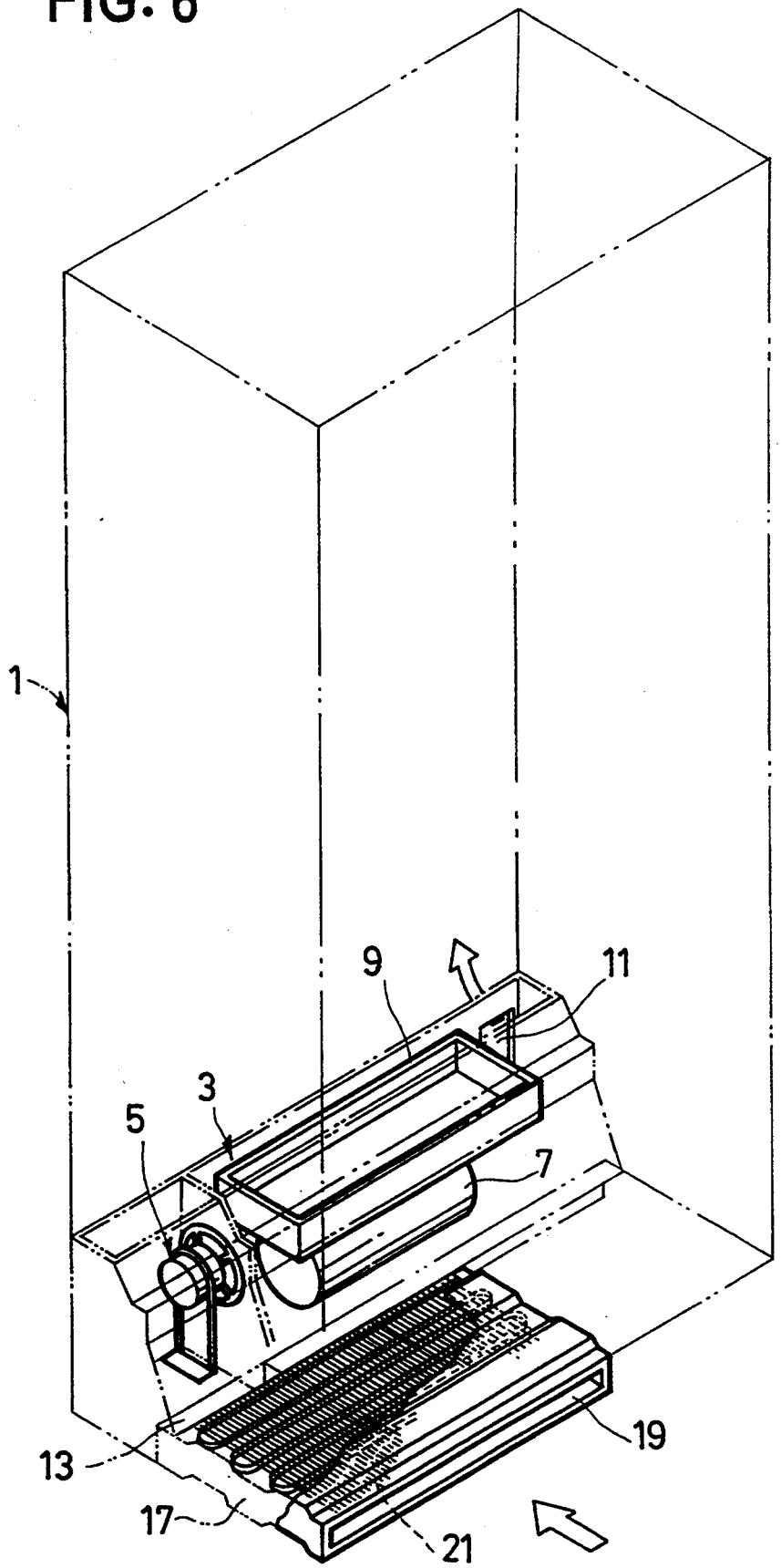
FIG. 6 shows a perspective and overall view of the refrigerator where the air duct passage thereof is characterized in accordance with the first embodiment of the present invention.

FIG. 6 shows a perspective and overall view of a refrigerator according to the first embodiment of the present invention where a configuration indicated with a dotted line shows a body of the refrigerator including a freezer and a refrigerator compartment. There is provided a machine compartment 3 under the body of the refrigerator.

Referring to the same figure, there is provided an axial fan 5 for causing an air flow, a compressor 7 and a pan 9 which collects defrost water that is drained thereto. The pan 9 is disposed above the compressor 7. There is further provided an exhaust port 11 in the downstream side of the machine compartment 3, an opening portion 13 and an air duct 17 which provides an air passage 15 (see FIG. 3) and is connected to the opening portion 13. An intake 19 is located in a front side of the air passage 15 and there is disposed a wire condenser 21 therein in a horizontal direction.

Figure 1:
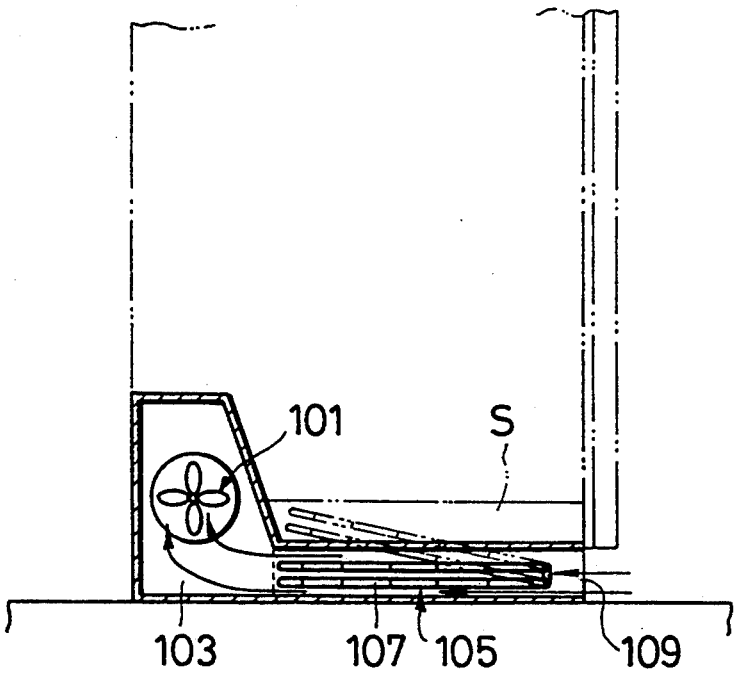
FIG. 1 PRIOR ART
FIG. 1 shows a cross sectional view of an air duct passage where a conventional solution for increased cooling efficiency is applied.
Figure 3:
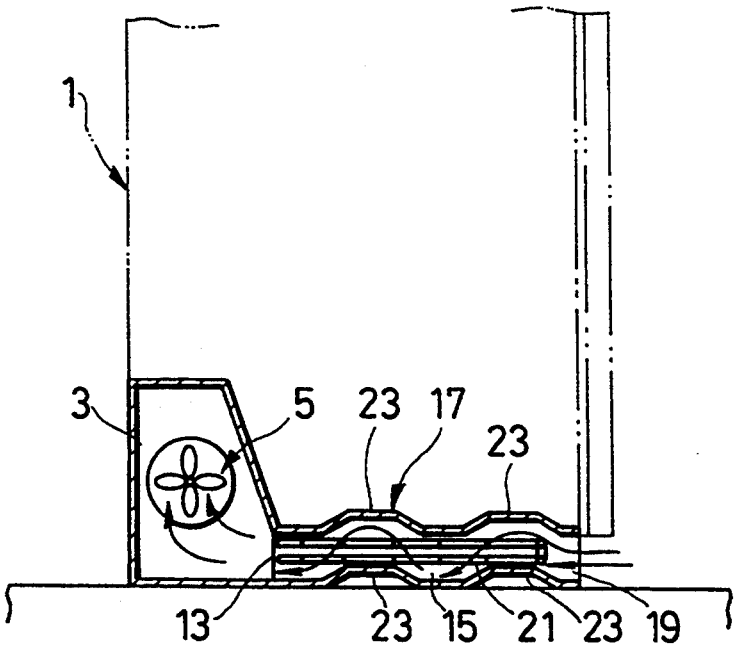
FIG. 3 shows a cross sectional view of the air duct passage according to the first embodiment of the present invention.
Figure 2A:
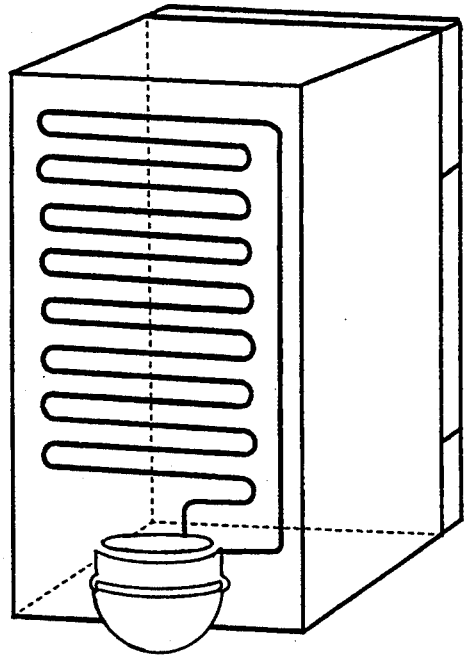
FIG. 2A PRIOR ART
FIG. 2A shows a conventional refrigerator with a hot wall condenser attached on the rear side thereof.
Figure 2B:
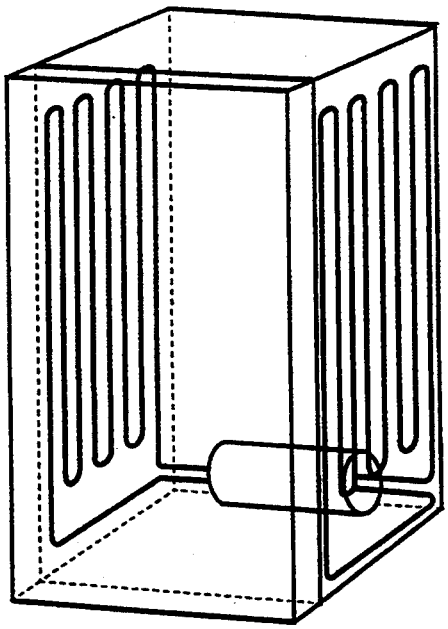
FIG. 2B PRIOR ART
FIG. 2B shows a conventional refrigerator with a hot wall condenser attached on both the left and right sides thereof.

FIG. 3 also shows the first embodiment of the present invention. A cooling air guiding portion 23 is provided in which cooling air is repeatedly guided from an upper surface to a lower surface of the wire condenser 21 and vice versa, starting from the intake 19 toward the machine compartment 3. In other words, an upper cover and a bottom cover of the air duct 17 are projected alternately into the duct so that an upper side and a lower side of the air passage 15 are alternately blocked, thereby, causing the cooling air to flow in a zigzag manner. It is to be noted that the projecting portion of the air duct 17 in the first embodiment serves as a stiffening rib for increasing the strength of the air duct 17.

Figure 4:
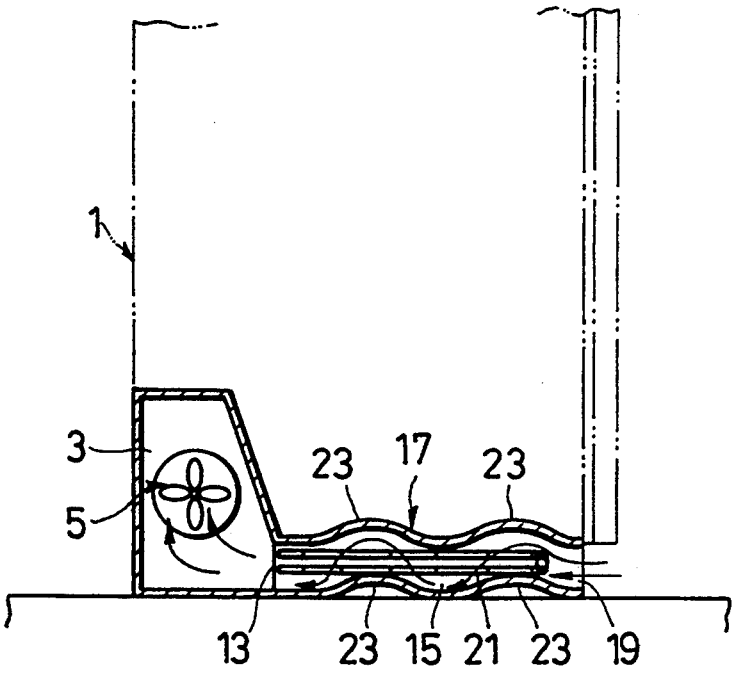
FIG. 4 shows a cross sectional view of the air duct passage according to the second embodiment of the present invention.

FIG. 4 shows the second embodiment of the present invention where the air guiding portion 23 shown in FIG. 3 of the first embodiment is in the shape of the air duct 17 which meanders smoothly. It should be understood that a uniform width of the air duct 17 provides for the best efficiency.

Figure 5:
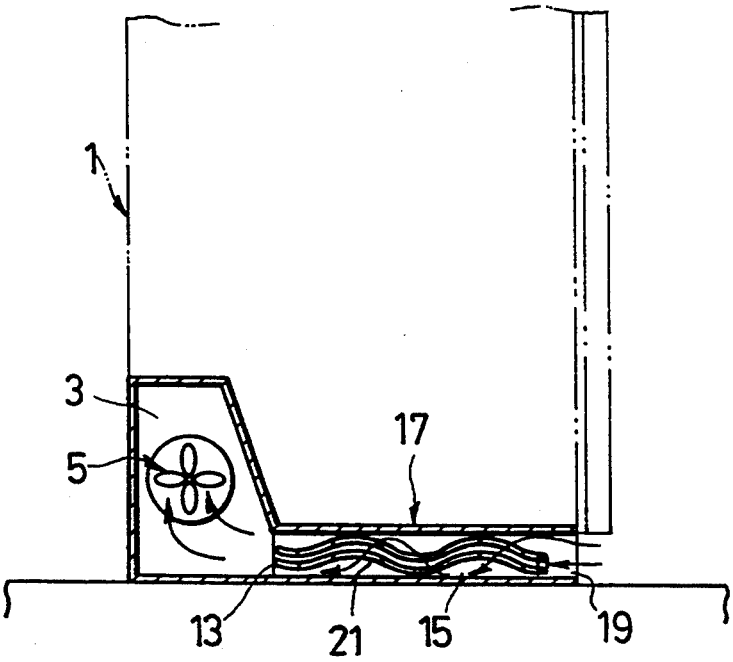
FIG. 5 shows a cross sectional view of the air duct passage and the wire condenser according to the third embodiment of the present invention.

FIG. 5 shows the third embodiment of the present invention in which the air duct 17 forms a horizontal air passage and the wire condenser 21 is shaped in a similar manner as the air duct in the above second embodiment.

Figure 7:
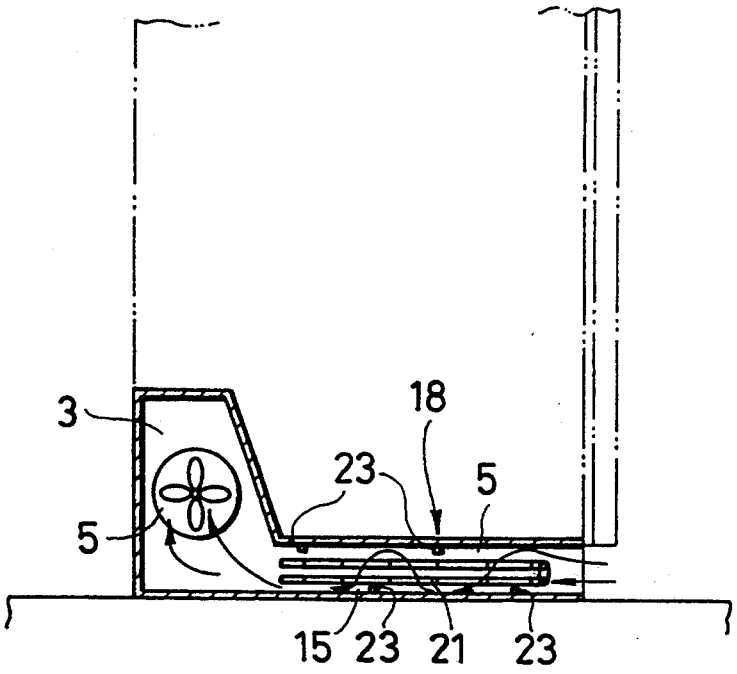
FIG. 7 shows a cross sectional view of the air duct passage and the wire condenser according to the fourth embodiment of the present invention.

FIG. 7 shows the fourth embodiment of the present invention where there are provided vertical blocking plates which alternately project into the air guiding portion 23 from the ceiling and bottom of the air duct 18. As a result, the upper side and lower side of the air passage 15 are alternately blocked so that the cooling air flows in a zigzag manner. The fourth embodiment is convenient in that little modification will be required on a wire condenser unit currently in use.

It shall be appreciated that sound absorption material may be applied over the air passage in the above first through fourth embodiments.

In a refrigerator whose wire condenser portion is constructed according to the above embodiments, the cooling air entering the intake by means of the axial fan flows through the air duct in a repeated zigzag direction from an upper side to a lower side of the air duct and vice versa toward the machine compartment and is discharged from the exhaust port. Thereby, heat produced by the wire condenser will be effectively radiated.

Figure 9:
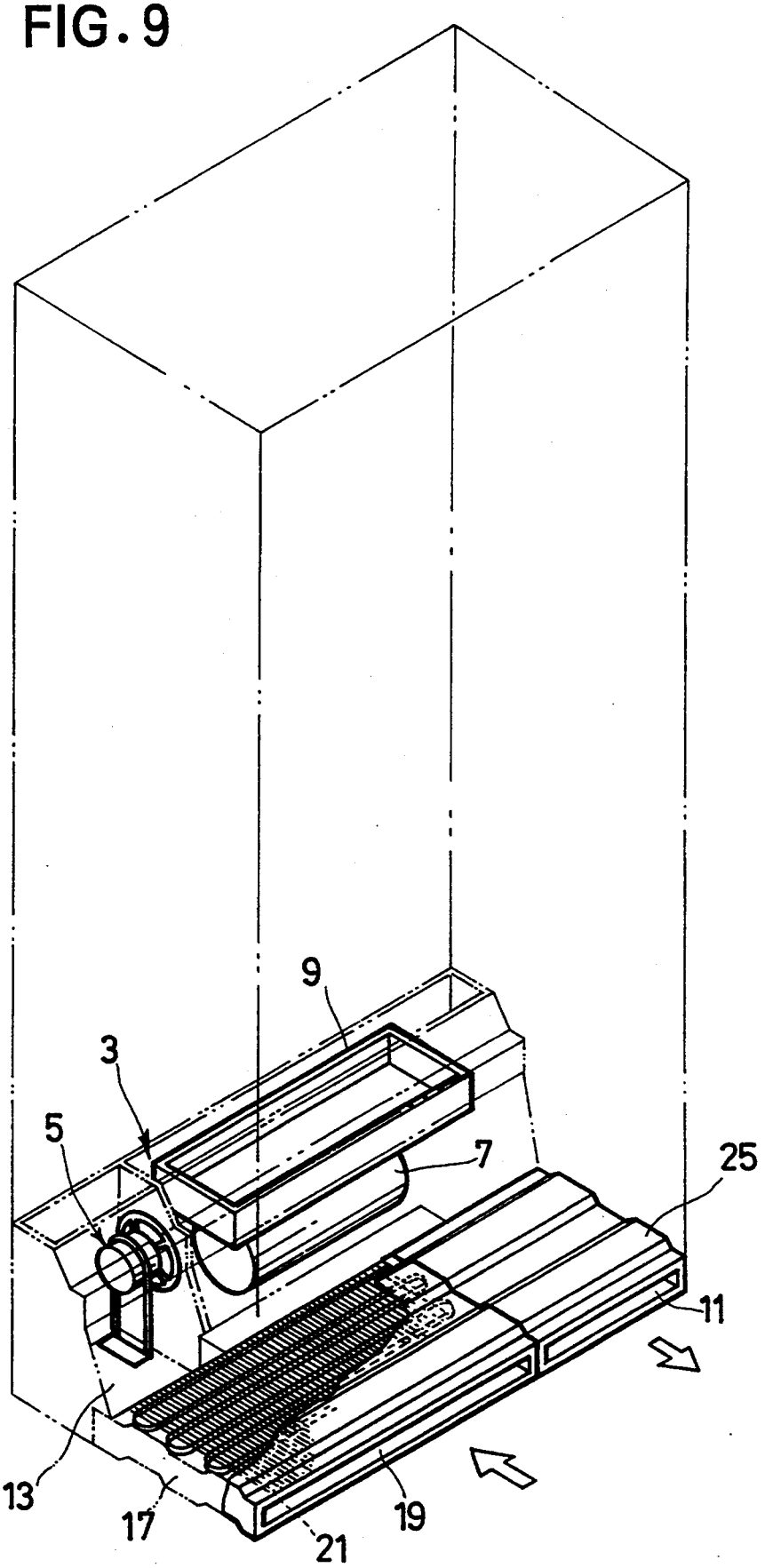
FIG. 9 shows a perspective and overall view of the refrigerator according to the present invention, wherein an exhaust slot is provided in the front side of the refrigerator.

With reference to FIG. 9, an exhaust duct 25 connected to the machine compartment 3 may be arranged so that the cooling air is discharged from a front side of the refrigerator. With this layout, the refrigerator can be built into a wall or the like as part of a systematized kitchen.

As described above, the air duct is alternately projected from the upper surface to the lower surface thereof and vice versa, so that the projected portion serves as a stiffening rib. At the same time, a noise generated from the machine compartment will be damped effectively by a structure where the air duct is of a zigzag shape.

Figure 8:
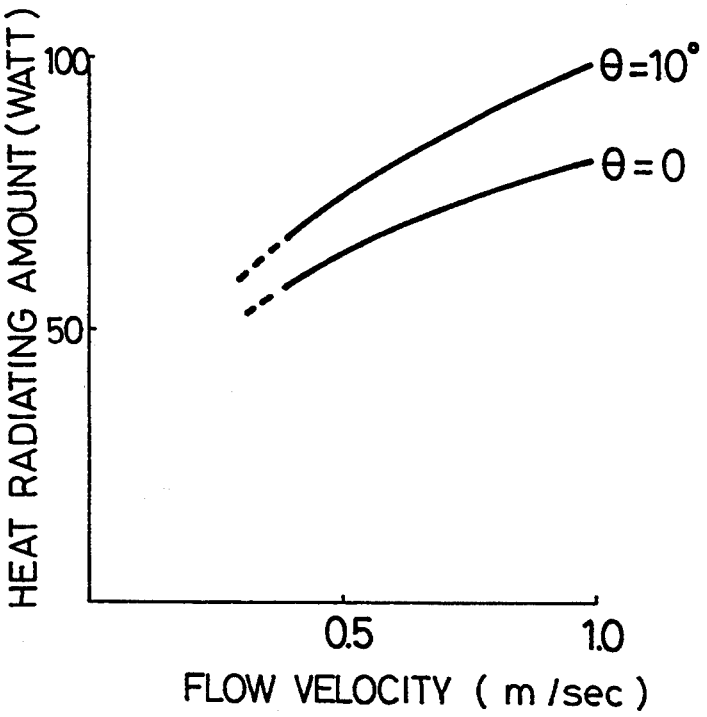
FIG. 8 is a graph showing the correlation between a heat radiating amount (WATT), an air flow velocity (m/sec) and an inclination angle of the air duct passage.

By employing the zigzag construction for the wire condenser portion, the cooling air flowing in the air passage moves from the upper side to the lower side of a wire condenser unit, and vice versa, so that the cooling air crosses through the wire condenser which removes heat from the wire condenser. Referring to FIG. 8, there is shown a correlation between a heat radiating amount in Watts, an air flow velocity (m/sec) in the air passage and an inclination angle of the air duct. By employing the present invention, the same result is obtained as in the case where the straight air duct is tilted by 10 degrees. The result being that the amount of heat radiated is increased by 20 percent. However, as discussed above, the cross section for the wire condenser unit remains intact.

Since an overall air passage of the cooling air guiding portion 23 becomes longer by the zigzag construction of the present invention, the noise generated from the machine compartment 3 is further suppressed. When the sound absorption material is used together with the zigzag construction described above, the noise from the machine compartment 3 is further damped to a minimum.

In summary, the present invention achieves the most effective flow of the cooling air for removing the heat radiated from the wire condenser without increasing the cross section of the air passage.

Moreover, the noise generated from the machine compartment can be suppressed to a minimum, thus being desirous for users, especially those who lives and sleep in the same room where a refrigerator is placed.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. A refrigerator comprising:

a machine compartment having a fan therein for causing a flow of cooling air, located at a bottom of the refrigerator;

an air passage duct, connected to the machine compartment, containing a wire and tube condenser, the air duct and the wire and tube condenser being placed at the bottom of the refrigerator; and an exhaust port for discharging heated air radiated from the wire and tube condenser, wherein the air passage duct is formed in a zigzag shape so that the cooling air flowing through the air passage duct crosses through the wire and tube condenser.

2. The refrigerator as recited in claim 1, wherein an upper cover and a bottom cover of the air passage duct are projected alternately so that an upper side and a lower side of the air passage 15 are blocked alternately.

3. The refrigerator as recited in claim 2, wherein sound absorption material is applied inside the air passage duct.

4. The refrigerator as recited in claim 1, wherein the air passage duct is meandered smoothly so that the cooling air crosses through the wire condenser.

5. The refrigerator as recited in claim 4, wherein sound absorption material is applied inside the air passage duct.

6. A refrigerator comprising:

a machine compartment having a fan therein for causing a flow of cooling air, located at a bottom of the refrigerator;

an air passage duct, connected to the machine compartment, containing a wire and tube condenser, the air duct and the wire and tube condenser being placed at the bottom of the refrigerator; and an exhaust port for discharging heated air radiated from the wire and tube condenser, wherein the wire and tube condenser is meandered smoothly so that the cooling air flowing through the air passage duct crosses through the meandering wire and tube condenser.

7. The refrigerator as recited in claim 6, wherein sound absorption material is applied inside the air passage duct.

8. The refrigerator as recited in claim 1, wherein there are provided a plurality of vertical blocking portions projected within the air passage duct from a ceiling and bottom thereof alternately, at a predetermined interval, so that the cooling air crosses through the wire condenser.

9. The refrigerator as recited in claim 8, wherein sound absorption material is applied inside the air passage duct.

* * * * *